US006575328B1

(12) United States Patent
Foraker

(10) Patent No.: US 6,575,328 B1
(45) Date of Patent: Jun. 10, 2003

(54) JOINT COMPOUND CONTAINER AND INSULATING PAD

(76) Inventor: Danny D. Foraker, 8190 Pheasant St. NW., North Canton, OH (US) 44720

( * ) Notice: Subject to any disclaimer, the term of this patent is extended or adjusted under 35 U.S.C. 154(b) by 0 days.

(21) Appl. No.: 09/292,155

(22) Filed: Apr. 15, 1999

(51) Int. Cl.[7] ..... B65D 25/20; B65D 25/34

(52) U.S. Cl. ..... 220/739; 220/23.91; 220/592.24; 220/592.25; 220/732

(58) Field of Search ..... 220/739, 592.01, 220/592.2, 592.21, 592.24, 592.25, 592.26, 23.91, 630, 632, 636, 729, 695, 732, 737, 753

(56) References Cited

U.S. PATENT DOCUMENTS 4,367,692 A * 1/1983 Underwood et al. ..... 118/415
4,961,849 A * 10/1990 Hull et al. ..... 210/169
5,397,628 A * 3/1995 Crawley et al. ..... 428/314.4 X
5,603,428 A * 2/1997 Breckwoldt ..... 220/755
5,725,122 A * 3/1998 Murphy et al. ..... 220/521
5,845,804 A * 12/1998 Prescott ..... 220/739
5,873,486 A * 2/1999 Morgan ..... 220/739
6,006,936 A * 12/1999 Przybylowicz ..... 220/23.8
6,079,316 A * 6/2000 Barden et al. ..... 220/449
6,250,005 B1 * 6/2001 Richards ..... 215/12.1
6,286,798 B1 * 9/2001 Chun ..... 220/907

* cited by examiner

*Primary Examiner*—Lee Young
*Assistant Examiner*—Niki M. Eloshway
(74) *Attorney, Agent, or Firm*—Sand & Sebolt

(57) ABSTRACT

A removable insulation grip member used with a compound container fabricated from metal has a body with a magnetic material layer connected to the body. The magnetic materials layer is used to connect the body to the container. The magnetic material layer includes at least first and second magnetic material portions spaced from one another with the body of the grip member disposed between the first and second magnetic material portions functioning as a living hinge allowing the body to bend around a corner of the container. The grip member insulates the user's hand from the cold material in the compound container.

8 Claims, 2 Drawing Sheets

A-A

JOINT COMPOUND CONTAINER AND INSULATING PAD

BRIEF SUMMARY OF THE INVENTION

This invention relates generally to containers for holding materials such as workable cement and joint compounds combined with an integral insulating holding pad.

Joint compound containers, commonly called "mud pans", have been available for a long-time for use by dry wall finishers when joining previously-installed wall board and the joints there-between. The most commonly used mud pan comprises a flat bottom, two sloping sidewalls extending upwardly and laterally from the bottom, making generally sharp angles with the bottom wall, and two similarly-sloping end walls terminating in a planar upper edge. The pans are normally trapezoidal in shape and somewhat difficult to hold when retaining the joint compound, especially for lengthy working periods. This is primarily true because the pan shape does not fit the worker's hand. The mud pan is normally lightweight and comprised of stainless steel which promotes uncomfortable heat transfer from a worker's hand, particularly on cold days and in colder climates. Also the matter of loading the pan with relatively cold joint compound from a cold storage container adds to the hand heat-transfer problem which exists between the pan-holding hand and the container.

U.S. Pat. No. 5,603,428 to Breckwoldt discloses a round-bottomed container for joint compounds having a top member and a contoured grip member fastened to its bottom. The grip member is comprised of solid wood or solid plastic and is permanently attached to the container bottom wall by a strong adhesive or cement. The grip has a flat bottom to add stability to the round-bottomed container when seated on a flat surface. The grip is essentially non-insulating due to its solid structure and is integrally and permanently attached to the container. The grip is described as specifically contoured to fit the person's hand; however, due to its rigid structure it is not adaptable to fit the different-sized hands of many workers. The lack of resilence in the grip described in the reference, its non-insulating characteristics, and its non-separability from the container have severely limited or prevented its commercial use. The pan is further described in a second embodiment as comprised of plastic, but such modification does not prevent or ameliorate the heat transfer problem.

A primary objective of the present invention is to provide an improved container which is well suited to dispensing materials such as workable joint compounds or cement, the container having a separable insulating pad which is form-fitting to a person's hand for easy retention for long periods of time. The improved container is insulating in character and clearly inhibits heat transfer from the worker's hand in cold or inclement weather, and which container and separable pad are easy to clean when separated.

The improved container of the present invention is capable of retaining and dispensing workable materials such as cement, joint compounds, plaster, mortar, adhesives and the like. The materials are applied from the container with an applicator or knife to an object such as a wall or wall panel joints. The container comprises an open top terminating in a planar upper edge, its walls retaining a specific volume of the material to be applied. The joint compounds are usually applied to the joints or open spaces between panels to create smooth planar surfaces for painting or wallpapering, as desired.

Another object of the present invention is to provide a combined container and insulating pad which is readily separable from the container for easy cleaning and reuse. The pad is soft, to the touch and readily moldable to the hand of the worker when holding the container in one hand and an applicator tool or knife in the other hand. The pad is laminated consisting basically of foam neoprene rubber and a magnetic material layer in direct contact with exterior surfaces of the container. The pad preferably has waterproof exterior surfaces to allow easy cleaning of both the container and pad with water or other solvent when separated.

In the attached accompanying drawings, the designated views of the container and insulating pad show the combination in their combined and separated states for use in containing and using joint compounds. Other objects and features of the invention will be in part apparent and particularly pointed out hereinbelow.

DETAILED DESCRIPTION OF THE PREFERRED EMBODIMENT

Figure 1:
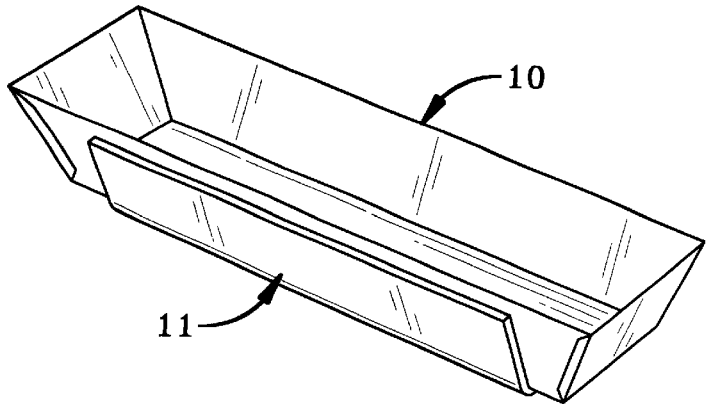
FIG. 1 is a perspective view of the combined container and insulating pad taken from above the empty container.

With reference to the drawings, FIG. 1 is directed to the combined container 10 and a partially surrounding insulated pad 11 which container is commonly referred to as a "mud pan" for containing joint compounds for use in dry wall installing and finishing. The container is particularly suited for retaining materials such as normally-used multi-purpose joint compound having joint sealing characteristics.

The joint compounds are used for embedding joint-tape and for filling and finishing gypsum-board panel joints, corner beads, trim and wall fasteners. The joint compounds are normally shipped in 5 gallon pails or plastic bags in essentially dry condition. Water is added and the compounds are mixed into uniform workable condition having the consistency of creamy mashed potatoes. The water usually used is nearly always cold at construction sites. The plastic bags containing dry joint compounds require the use of cold water for mixing. Hot or warm water for mixing causes the newly-mixed compounds to possess an unduly-fast set-up time which is objectional for their end use. The materials then have a tendency to become hardened or become unspreadable in the pan or container where mixed. The newly-mixed joint compounds are always colder or at a lower temperature than the human hand. The stainless steel pan 10 used by dry wall installers holding the mixed joint compound is always cold to the touch making dry walling work difficult to sustain for long periods.

Figure 2:
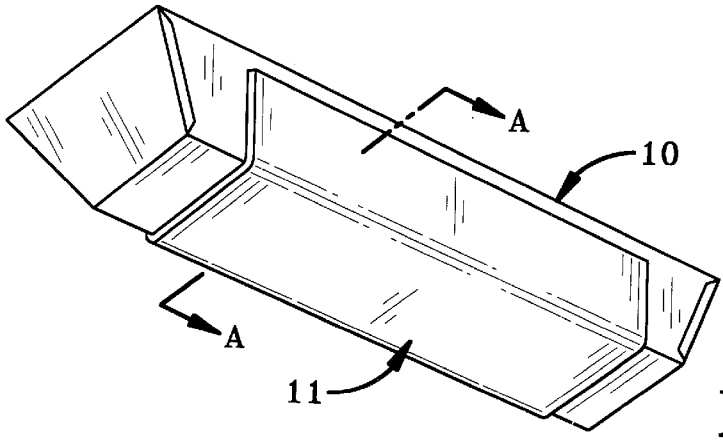
FIG. 2 is a perspective view of the combined container and insulating pad taken from below the empty container.
Figure 5:
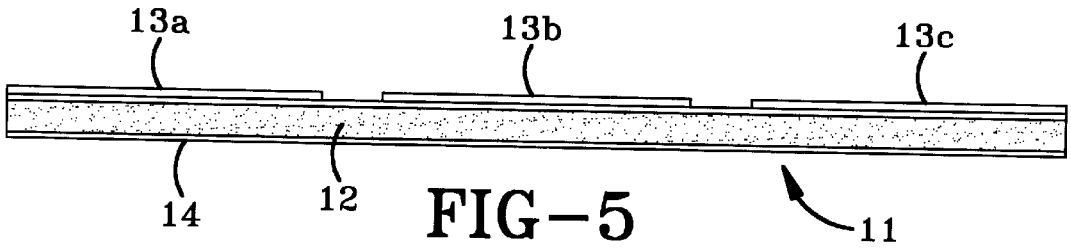
FIG. 5 is an enlarged cross-sectional view of the pad alone taken along the line B—B showing its laminated construction with the magnetic layer of the pad facing upwardly.

The insulating pad 11 is comprised of a laminated structure consisting basically of a foam rubber layer 12 and a magnetic material layer 13. The pad 11 is shown attached to the container 10 in FIGS. 1 and 2 in perspective views. The pad 11 has an insulating character which is soft to the touch and moldable to a person's hand when compressed. The pad is preferably comprised of a foamed rubber layer 12 mostly one which is water-resistant such as foamed neoprene rubber-having a thickness substantially thicker than the second layer of magnetic material. The first layer of neoprene rubber has a thickness of about ¼ inch and the second layer of magnetic material is about 1/16 inch in thickness. The neoprene rubber in foamed condition is preferred due to its being waterproof for easy cleanup of the pad. The second layer 13 of magnetic material is essentially solid and substantially thinner than the foam rubber layer 12. In the event that another foam rubber layer is used for the pad such as open-celled natural rubber, the pad may have a waterproof exterior layer of a waterproofing coating such as a thin synthetic varnish applied to the pad such as layer 14 shown in FIG. 5.

Figure 3:
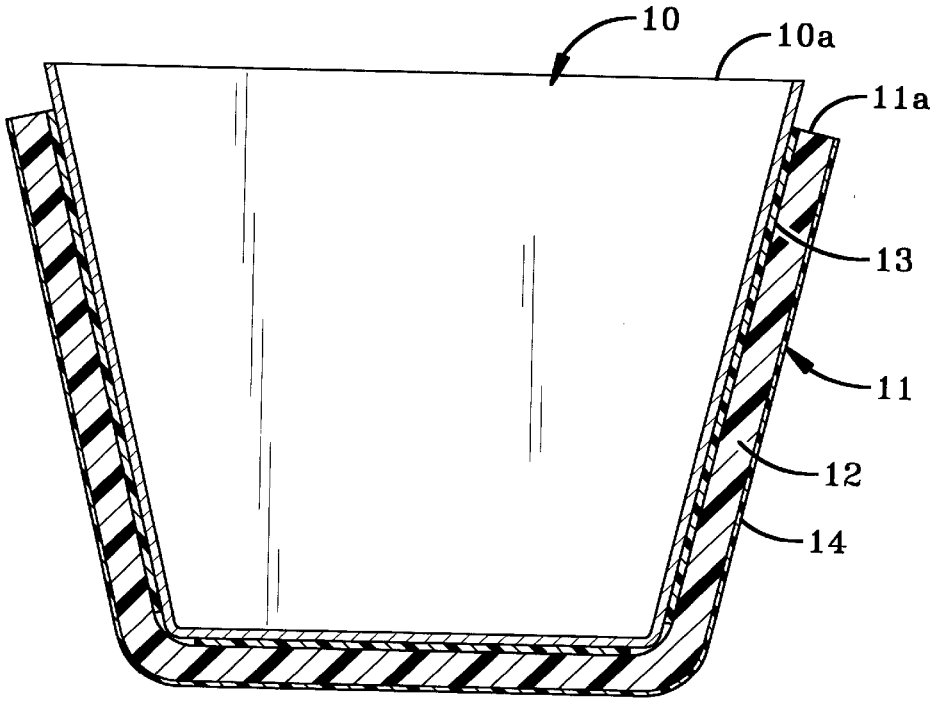
FIG. 3 is an enlarged cross-sectional view of the combined container and pad taken along the line A—A of FIG. 2
Figure 4:
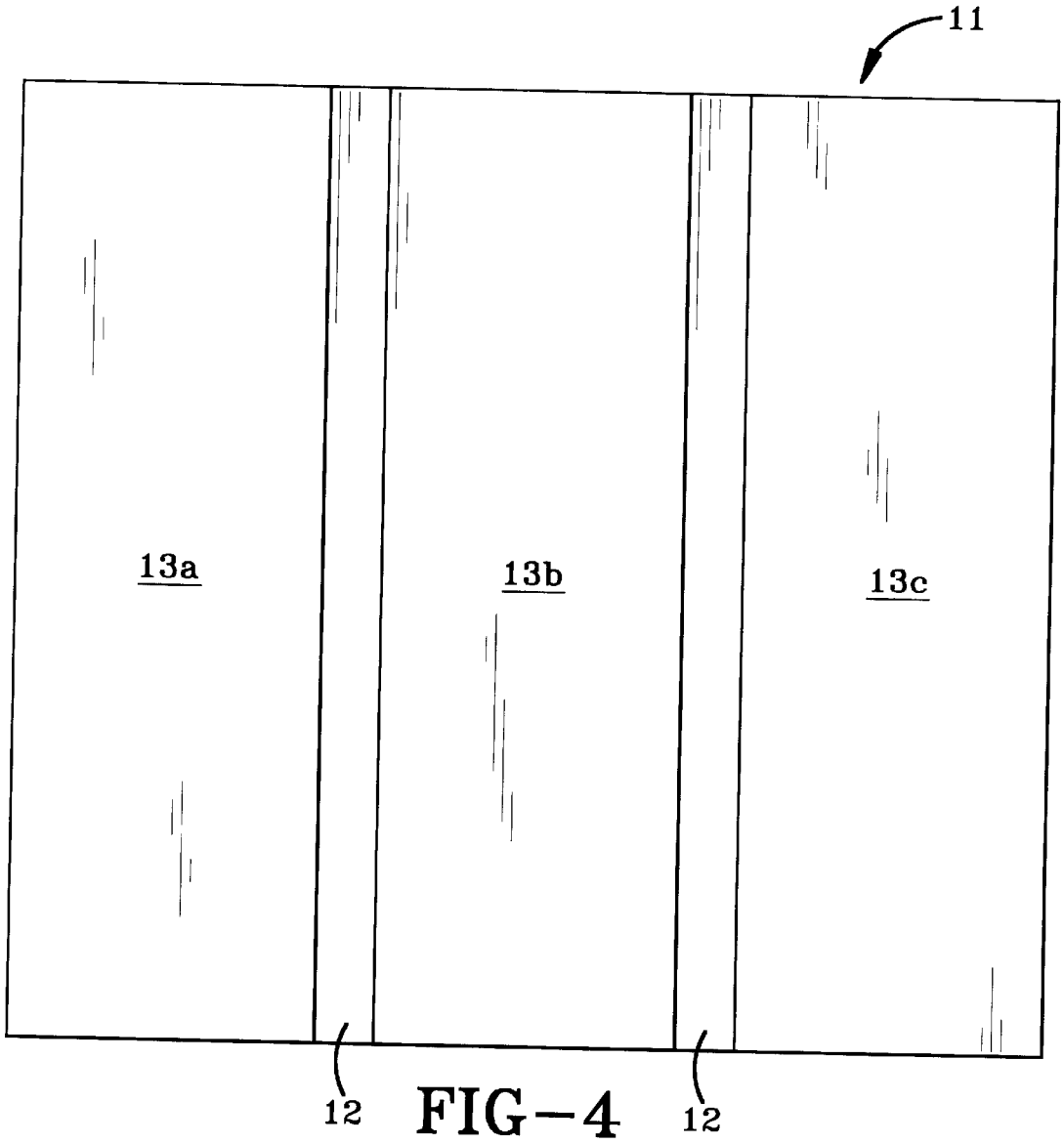
FIG. 4 is an enlarged top plan view of the pad alone showing its segmented construction with the magnetic layer of the pad facing upwardly.

FIG. 4 shows the generally segmented nature of the pad 11 in a top plan flattened view. The foam rubber layer 12 being very flexible is uniform in thickness throughout the full extremities of the pad. The second layer 13 of magnetic material is firmly adhered to the foam rubber such as by a self-sticking adhesive layer. The second layer of magnetic material being semi-rigid in character is Segmented into three individual segments 13*a*, 13*b* and 13*c* as shown in FIG. 4. The segmented nature of layer 13 allows the pad to be easily-fitted around the sharp corners existant at the pan bottom and sloping sidewalls. The pad has a length greater than the normal width of a human hand to allow variable grasping of the pad by one hand. Normally, the loaded pan is grasped by the hand at or near its center of gravity for worker's convenience during drywalling operations. The pad width extends to closely adjacent the upper edges of the pan sidewalls for easy cleaning of pan and pad. The pad is so tightly restrained by the pan that substantially no joint compound flows downwardly between the pad and pan sidewalls during use of the combined container with the above-described pad. The upper edge of the pan is designated as numeral 10*a* in FIG. 3. Both pan and pad are easily washed with water after their use when the two are separated. The pad is designed for repeated use and reuse after washing.

A preferred material for.the resilient flexible foamed rubber layer 12 consists of Product No. 6110 of Griswold Rubber Company, Inc. of Moosup, Conn., which is a neoprene open cell sponge rubber having a strength of about 2 to 5 psi. It is a neoprene medium oil swell rubber which is termed a soft foam rubber having an accelerated ageing of about +20% for use in the temperature range of −40° F. to about 175° F. and an average density of about 18 pounds per cubic foot. The material is waterproof for improved cleanup of the pad.

The magnetic material of the pad, i.e. layer 13, preferably consists of a rubberized sheet of magnetic material such as Product No. ZG-2024P of the Magnet Source Company of Castle Rock, Colo. having a thickness of about 0.020 inch. The combined-materials of the pad readily withstand repeated washings with water without deleterious effects on the pad. All components of the pad are designed for long term use as desired or required.

Drywall finishers who have used the subject combined pan and pad in long-term useage are noticeably less tired at the end of a working day, with the improved container providing greater comfort to the retaining hand and arm during its extended use. The subject container is easier to hold onto with markedly less heat transfer from the filled container to the hand.

In the foregoing description, certain terms have been used for brevity, clearness and understanding; but-no unnecessary limitations are to be implied therefrom beyond the requirement of the prior art, because such terms are used for descriptive purposes and are to be broadly construded.

Moreover, the description and illustration of the invention are by way of example, and the scope of the invention is not limited to the exact details shown or described.

Various modifications may be resorted to within the spirit and scope of the appended claims.

I claim:

1. In combination, a container for holding a joint compound applied from the container with an applicator to an object, said container comprising a generally hollow metal pan having an elongated flat bottom, two sloping sidewalls extending upwardly from the bottom, and two sloping end walls extending upwardly from the bottom, all four walls terminating in a planar upper edge, and an insulating separable pad member firmly temporarily attached exteriorly to said container, said pad member comprised of a foam rubber layer and a magnetic material layer located adjacent to said container exterior, said pad member having a length and a width encompassing the major surfaces of said bottom and said sidewalls of said container for insulated handling.

2. The combination of a container and a separable insulating pad member in accordance with claim 1, wherein the said pad member is comprised of a foamed neoprene rubber layer having a thickness of about ¼ inch and a magnetic material layer having a thickness of about 1/16 inch in contact with the container exterior surfaces.

3. The combination of a container and a separable insulating pad member in accordance with claim 1, wherein said pad member has an exterior waterproof coating over its exterior surfaces for making said pad member impervious to water absorption.

4. The combination of a container and a separable insulating pad member in accordance with claim 1, wherein said pad member is comprised of a uniform layer of soft open-cell neoprene sponge rubber having an average density of about 18 pounds per cubic foot and a tensile strength at about 25% psi of about 2 to 5.

5. The combination of a container and a separable insulating pad member in accordance with claim 1, wherein the said container is comprised of relatively thin stainless steel.

6. The combination of a container and a separable insulating pad member in accordance with claim 1, said pad member having a width extending to adjacent the upper edges of said container for easy cleaning of said container and pad member when separated.

7. The combination of a container and a separable insulating pad member in accordance with claim 1, wherein the said insulating pad member comprises a relatively-soft resilient laminated member having foamed neoprene rubber as its primary layer and a magnetic material as its secondary layer contacting the major surfaces of said container.

8. In combination, a container for holding a joint compound applied from the container with an applicator to an object, the container including a generally hollow metal pan having an elongated flat bottom and two sidewalls extending upwardly from the bottom; and an insulating pad member removably attached to the exterior of the container;

the pad member including a foam rubber layer and a magnetic material layer;

the magnetic material layer adapted to removably attach the foam rubber layer to the exterior of the container;

the magnetic material layer including first, second, and third individual magnetic material portions; each of the magnetic material portions being spaced apart from one another;

the first and third magnetic material portions connecting the pad to the sidewalls of the container;

the second magnetic material portion connecting the pad to the flat bottom of the container;

the foam material disposed between the magnetic material portions functioning as living hinges allowing the pad to bend around the corners of the container.

* * * * *